US008427059B2

(12) United States Patent
Betsuda et al.

(10) Patent No.: US 8,427,059 B2
(45) Date of Patent: Apr. 23, 2013

(54) LIGHTING DEVICE

(75) Inventors: Nobuhiko Betsuda, Yokohama (JP); Takumi Suwa, Tokyo (JP); Hitoshi Kawano, Yokohama (JP); Akiko Saito, Yokohama (JP); Makoto Bessho, Yokohama (JP); Yusuke Shibahara, Yokosuka (JP); Hiroki Tamai, Yokosuka (JP); Nobuo Shibano, Miura (JP); Keiichi Shimizu, Yokohama (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 922 days.

(21) Appl. No.: 12/511,522

(22) Filed: Jul. 29, 2009

(65) Prior Publication Data

US 2010/0026185 A1 Feb. 4, 2010

(30) Foreign Application Priority Data

| | | |
|---|---|---|
| Jul. 31, 2008 | (JP) | 2008-199035 |
| Sep. 30, 2008 | (JP) | 2008-252562 |
| Sep. 30, 2008 | (JP) | 2008-252567 |
| Sep. 30, 2008 | (JP) | 2008-252742 |
| Oct. 30, 2008 | (JP) | 2008-280062 |

(51) Int. Cl.
*H01K 1/58* (2006.01)

(52) U.S. Cl.
USPC ..... 315/32; 315/113; 315/309; 313/45; 313/46; 313/318.01; 313/318.09; 362/184; 362/240; 362/351; 362/800

(58) Field of Classification Search ..... 313/45, 313/46, 318.01, 318.09; 315/32, 113, 309; 362/184, 240, 294, 351, 800
See application file for complete search history.

(56) References Cited

U.S. PATENT DOCUMENTS

| | | | | |
|---|---|---|---|---|
| 6,499,860 | B2 | 12/2002 | Begemann | |
| 7,226,189 | B2 * | 6/2007 | Lee et al. | 362/294 |
| 7,802,903 | B1 | 9/2010 | Wray | |
| 7,874,699 | B2 | 1/2011 | Liang | |

(Continued)

FOREIGN PATENT DOCUMENTS

| | | | |
|---|---|---|---|
| CN | 101201157 | A | 6/2008 |
| JP | 2005-093097 | A | 4/2005 |
| JP | 2006-310057 | A | 11/2006 |
| JP | 2007-265892 | A | 10/2007 |

OTHER PUBLICATIONS

Notification of Reasons for Refusal for the corresponding Japanese Patent Application No. 2008-199035 dated, Jul. 4, 2012.

(Continued)

*Primary Examiner* — Douglas W Owens
*Assistant Examiner* — Thai Pham
(74) *Attorney, Agent, or Firm* — Banner & Witcoff, Ltd.

(57) ABSTRACT

A substrate is attached to one edge side of a radiator and a globe is attached covering the substrate. Heat-radiating fins are provided on the other edge side of the radiator and an air-cooling unit is rotatably provided inside the heat-radiating fins which enables to freely rotate. A case storing a circuit part is attached to the other edge side of the radiator and a cap is provided to the case. By the wind blast from the air-cooling unit, the heat-radiating fins are caused to be a part of the ventilation path to allow for ventilation of the inside of the radiator.

5 Claims, 13 Drawing Sheets

U.S. PATENT DOCUMENTS

| | | | | |
|---|---|---|---|---|
| 8,123,381 | B1 | 2/2012 | Wray | |
| 2005/0111234 | A1* | 5/2005 | Martin et al. | 362/555 |
| 2005/0152146 | A1 | 7/2005 | Owen et al. | |
| 2005/0174780 | A1 | 8/2005 | Park | |
| 2006/0227558 | A1* | 10/2006 | Osawa et al. | 362/351 |
| 2007/0237636 | A1 | 10/2007 | Hsu | |
| 2009/0059595 | A1 | 3/2009 | Ge | |
| 2009/0244899 | A1* | 10/2009 | Chyn | 362/294 |
| 2010/0026157 | A1 | 2/2010 | Tanaka et al. | |
| 2010/0165632 | A1 | 7/2010 | Liang | |
| 2010/0186937 | A1 | 7/2010 | Liang | |

OTHER PUBLICATIONS

Notification of Reasons for Refusal for corresponding Japanese Patent Application No. 2008-252567 dated Jul. 10, 2012.

Office action in related U.S. Appl. No. 13/595,607 mailed Sep. 25, 2012.

Office action for related U.S. Appl. No. 13/595,557 mailed Oct. 3, 2012.

Notification of Reasons for Refusal for corresponding Japanese Patent Application No. 2008-199035 mailed Mar. 6, 2013.

* cited by examiner

LIGHTING DEVICE

INCORPORATION BY REFERENCE

The present invention claims priority under 35 U.S.C. §119 to Japanese Patent Application Nos. 2008-199035, 2008-252562, 2008-252567, 2008-252742 and 2008-280062 filed on Jul. 31, 2008, Sep. 30, 2008, Sep. 30, 2008, Sep. 30, 2008 and Oct. 30, 2008, respectively. The contents of these applications are incorporated herein by reference in their entirety.

FIELD OF THE INVENTION

The present invention relates to a self-ballasted lamp which can substitute for a general light bulb.

BACKGROUND OF THE INVENTION

Conventionally, a substrate mounting an LED is attached to an edge of a radiator, a globe is attached to the edge of the radiator in a manner that the globe covers the substrate, a case for storing a lighting circuit for lighting the LED is attached to the other edge of the radiator, and a cap is provided to the other edge of the case in a self-ballasted lamp using an LED as a light emitting element.

In such a self-ballasted lamp, temperature of the LED is increased by the heat generated by the LED and such an increase in temperature causes a decrease in light emission of the LED, as well as shortened life of the LED. Therefore, it is requested to suppress a rise in temperature of the LED and for that purpose, for example, the radiator is formed of a metallic material having good thermal radiating properties or the like.

Moreover, although this is not a case of a self-ballasted lamp including a globe, there is known an LED lamp in which heat-radiating fins are provided in the periphery of the radiator and a fan is provided inside the radiator so that the heat transmitted from the LED to the radiator is forcibly radiated, as shown in Japanese Laid-Open Patent Publication No. 2007-265892.

However, in the case of a self-ballasted lamp having a globe, radiation efficiency of the LED is poor because the LED is covered with the globe and even if a metallic radiator is used, rise in temperature of the LED cannot be sufficiently suppressed.

Moreover, even if a heat-radiating fin is provided to the radiator of a self-ballasted lamp having a globe and a fan is provided inside the radiator like the case of an LED lamp without a globe so that heat transmitted to the radiator can be forcibly radiated, since the LED is covered with the globe, it is not possible to sufficiently suppress a rise in temperature of the LED.

The present invention has been made in consideration of such a problem and is aimed at providing a self-ballasted lamp which can improve radiation efficiency and suppress a rise in temperature of a light emitting element.

SUMMARY OF THE INVENTION

The present invention includes a substrate having one edge side surface on which a light emitting element is provided, a radiator having one edge to which the other edge side surface of the substrate is attached, a globe which covers the substrate and is attached to the one edge of the radiator, a cap provided on the other edge side of the radiator, a lighting circuit which is stored between the radiator and the cap and is for lighting the light emitting element, and an air-cooling unit which is provided on the other edge side of the radiator and allows for ventilation of the inside of the radiator.

The light emitting element includes, for example, a solid light emitting element such as an LED or an organic EL.

The substrate includes, for example, a metallic material such as aluminum having good heat radiating property. A substrate communication hole of the substrate may be provided at, for example, a center position of the substrate and a wiring for connecting the LED and the lighting equipment may pass through the hole.

The radiator may be formed of, for example, either a metallic material or a resin material. On the other edge side of the radiator a space which is a storage part for storing, for example, an air-cooling unit is formed. A radiator communication hole of the radiator may be provided at, for example, a center position of the radiator and a wiring for connecting the LED and the lighting equipment may pass through the hole.

The globe includes, for example, a material having light diffuseness such as glass or resin and is formed to have an approximately globular shape.

The cap includes an E17 type or an E26 type, for example, which can be connected to a socket for a general light bulb.

The lighting circuit is, for example, a circuit providing constant current DC power to the LED.

The air-cooling unit includes, for example, a sirocco fan or a centrifugal fan. If the air-cooling unit includes a sirocco fan, a space may be formed in the center portion and the wiring connecting the LED and the lighting equipment may pass through the space. The fan is rotated by drive of a fan motor controlled by a drive circuit part and may be driven continuously by the fan motor while power is supplied through the cap or a temperature sensor may be installed and the fan may be driven by the fan motor only when the temperature detected by the sensor exceeds a predetermined temperature or more. Moreover, the fan may radiate heat of the lighting circuit part as well as the heat transmitted from the LED to the radiator.

Then, providing the air-cooling unit inside the other edge side of the radiator to ventilate inside the radiator enables to improve radiation efficiency of the radiator and to suppress a rise in temperature of the light emitting element.

Moreover, in the present invention, the substrate communication hole for communicating one edge side surface of the substrate with the other edge side surface is provided to the substrate, the radiator communication hole for communicating one edge side with the other edge side is provided at a position communicating with the substrate communication hole to the radiator, and a ventilation hole communicating the inner side space covered with the globe with the outside is provided to at least either the radiator or the globe.

One or a plurality of ventilation holes may be provided and the ventilation hole may be provided to the radiator alone, to the globe alone, or may be provided to both the radiator and the globe. It is preferable that a ventilation filter is provided to the ventilation hole to prevent dust or insects from entering into the globe.

Then, because an inner space covered with the globe and the air-cooling unit are allowed to communicate by the substrate communication hole and the radiator communication hole and the inner space covered with the globe and the outside are allowed to communicate by the ventilation hole provided at least to either the radiator or the globe, circularity of outside air into the inner space of the globe is improved and radiation efficiency can be improved.

Moreover, the radiator of the present invention includes a resin material.

It is preferable that the radiator has a heat-radiation structure such as a plurality of heat-radiating fins so that sufficient heat radiation property can be obtained as a resin material.

Moreover, since the radiator is formed of a resin material, a case for insulating the lighting circuit to the radiator becomes unnecessary and therefore the number of components can be reduced and the size of the radiator can be smaller.

Further, in the present invention, the radiator includes a storage part where the air-cooling unit is stored inside and a drive circuit for driving the air-cooling unit which is provided to the substrate.

The storage part may be formed to have a concave shape on the other edge side of the radiator or maybe formed to penetrate the radiator.

The drive circuit is, for example, a circuit for supplying DC power to a motor of the air-cooling unit to rotation-drive the motor.

Then, the air-cooling unit is stored in the storage part inside the radiator to which the substrate is attached and at the same time the drive circuit for rotation-driving the air-cooling-unit is provided to the substrate. Thus, it becomes possible to provide both the air-cooling unit and the drive circuit in a smaller space and to respond to size reduction while ensuring cooling efficiency.

Further, in the present invention, the air-cooling unit includes a fan provided so as to face the other edge side of the substrate and a motor provided between the fan and the substrate to be attached at least to either the substrate or the radiator and driven by the drive circuit to rotation-drive the fan.

Then, the motor for rotation-driving the fan which is provided between the substrate and the fan provided so as to face the other edge side of the substrate and attachment of the motor at least to either the substrate or the radiator enable to cool the motor by rotation of the fan. Thus, cooling efficiency is improved and at the same time, space for supporting the axis of the motor can be saved to enable a greater reduction in size.

Moreover, in the present invention, the drive circuit is provided on the one edge side of the substrate.

Then, providing the drive circuit on the one edge side of the substrate enables the other edge side of the substrate to be flat and closely contact with the radiator and thus more efficient radiation is enabled.

DETAILED DESCRIPTION OF THE PREFERRED EMBODIMENTS

Hereinafter, embodiments of the present invention will be described with reference to the drawings.

Figure 1:
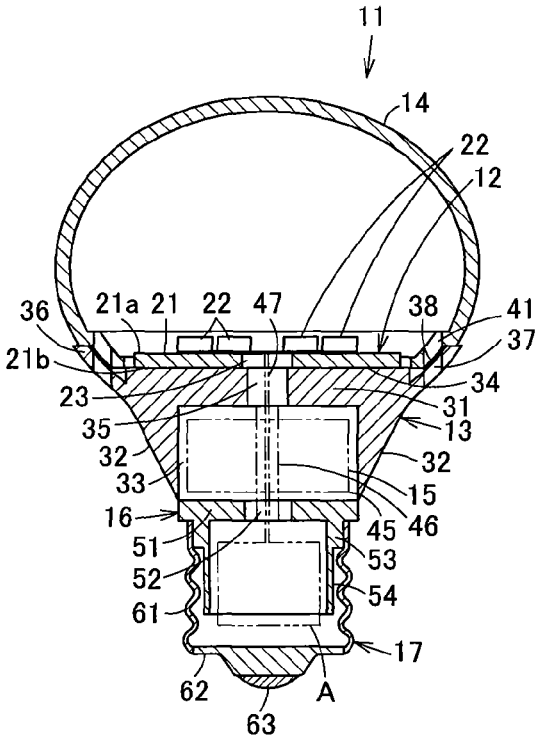
FIG. 1 is a cross-sectional view of a self-ballasted lamp showing an embodiment of the present invention.
Figure 2:
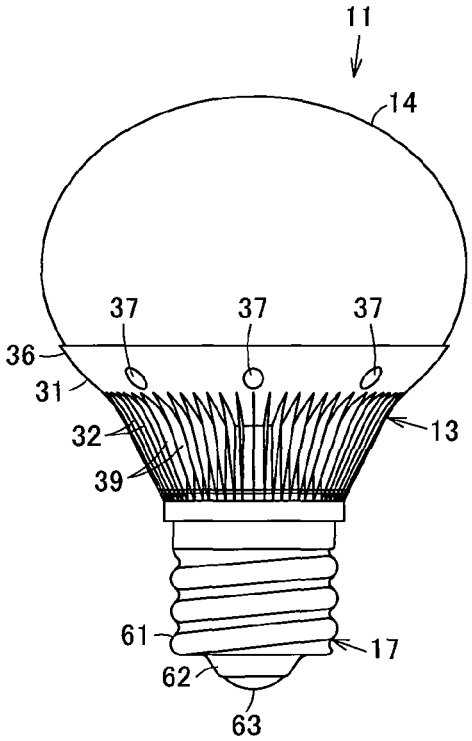
FIG. 2 is a side view of the self-ballasted lamp.

FIGS. 1 and 2 show an embodiment. FIG. 1 is a cross-sectional view of a self-ballasted lamp and FIG. 2 is a side view of the self-ballasted lamp.

Figure 11:
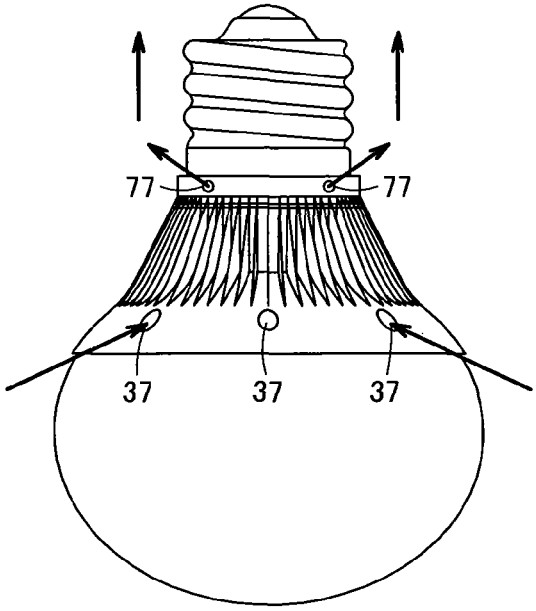
FIG. 11 is a view schematically showing a flow path of a self-ballasted lamp when an upper side of a cap is lit.

In FIGS. 1 and 2, 11 denotes a self-ballasted lamp. In the self-ballasted lamp 11, a substrate 12 which is an LED module is attached to a one edge side of a radiator 13 and to the one edge side of the radiator 13, a globe 14 is attached while covering the substrate 12. On the other edge side of the radiator 13, an air-cooling unit 15 is rotatably provided, and at the same time a case 16 storing a circuit part A including a lighting circuit part and a drive circuit for the air-cooling unit 15 is attached. A cap 17 is attached to the case 16. Here, the self-ballasted lamp 11 has the same length as a mini krypton lamp.

The substrate 12 includes a substrate main body 21 having a circular shape when seen planarly and a plurality of, for example, eight LEDs 22 which are light emitting elements mounted on a one main surface 21*a* side which is a one edge side of the substrate main body 21.

The substrate main body 21 is formed of a metallic material having good heat radiation property, for example, aluminum or the like, or an insulating material and a substrate communication hole 23 which is a round hole penetrating the one main surface 21*a* and the other main surface 21*b* on the other edge side is formed in a center position of the substrate main body 21. The other main surface 21*b* of the substrate main body 21 is closely fixed to a one edge surface of the radiator 13 so as to make a surface contact. To fix the substrate main body 21 to the radiator 13, a screw, a silicon series adhesive having good thermal conductivity, or the like is used.

The LEDs 22 include for example, a bare chip emitting blue light (not shown) and a resin part including a silicon resin or the like covering the bare chip (not shown). Inside the resin part, a fluorescent body, which mainly radiates a yellow color which is a complementary color of blue when excited by part of the blue light emitted by the bare chip, is mixed in so that each of the LEDs 22 can obtain white color series illuminated light. The fluorescent body has, for example, about 0.5 W of power consumption.

Moreover, the radiator 13 is formed integrally of a metallic material such as aluminum having good thermal conductivity and includes a radiator main body 31 and a plurality of heat-radiating fins 32 provided on an outer circumference surface of the radiator main body 31. On the other edge side of a radiator main body part 31 and inside the heat radiating fins 32, a fan storage space 33 as a storage portion where the air-cooling unit 15 is provided and stored is formed.

The radiator main body part 31 is formed to have a flat spherical shape from the other edge side to the one edge side as the diameter thereof is enlarged and on the one edge surface, a planar substrate attachment surface 34 of the one edge side to which the other main surface 21*b* of the substrate main body 21 of the substrate 12 is closely attached is formed. A radiator communication hole 35 which penetrates to a substrate attachment surface 34 and the other edge side is formed on a position which is the center position of the radiator main body part 31 and coaxially communicates with the substrate communication hole 23 of the substrate 21. On the outer periphery part of the one edge side of the radiator main body part 31, a globe attachment part 36 where an edge portion on the other edge side of the globe 14 is fitted and locked is formed along the circumferential direction of the radiator main body 31 to have a circular shape. At the position of the globe attachment portion 36, a plurality of ventilation holes 37 are formed in the circumferential direction at equal intervals and inside the ventilation holes 37, ventilation filters 38 having ventilation characteristics and preventing dust or insects from entering are provided.

The heat-radiating fins 32 are formed while inclining so as to allow a protrusion in the diameter direction from the other edge side to the one edge side of the radiator 13 to gradually become larger. Moreover, the heat-radiating fins 32 are formed in a radial pattern at substantially equal intervals between fins in the circumferential direction of the radiator 13 and a heat-radiation hole 39 having a slit-like shape is formed between the heat-radiating fins 32. It is preferable that the gap between the heat-radiating fins 32 in the circumferential direction is 5 mm or less. If the gap is 5 mm or less, it becomes possible to include many heat-radiating fins 32 to improve heat radiation efficiency together with the forcible air blast by the air-cooling unit 15. On the other hand, if the gap is larger than 5 mm, the number of heat-radiating fins 32 becomes small and it becomes impossible to sufficiently improve heat-radiation properties.

Moreover, the globe 14 is formed to have a flat spherical shape made of glass or synthetic resin having light diffuseness and is substantially continued to the globe attachment part 36 of the radiator 13. On an edge part of the globe 14, a plurality of ventilation holes 41 communicating with the ventilation holes 37 of the radiator 13 are formed. Between the ventilation holes 41 and the ventilation holes 37 of the radiator 13, a ventilation filter 38 intervenes.

Further, the air-cooling unit 15 includes, for example, a sirocco fan 45 which is a fan, and a fan motor for rotation-driving the sirocco fan 45 (not shown) which is a motor. In the air-cooling unit 15, the sirocco fan 45 is supported to be enabled to rotate by a center axis 46 the fan motor which is attached to the case 16. The center axis 46 is cylindrical and a lead wire 47 for connecting a circuit part A and the substrate 12 is wired through the axis.

A center portion of the sirocco fan 45 is opened and in the periphery thereof a plurality of fans are provided. When rotated, the sirocco fan 45 sucks air inside the self-ballasted lamp 11 from the center side and discharges the air in the outer diameter direction to discharge the air from the heat-radiating holes 39 between the plurality of heat-radiating fins 32 of the radiator 13. At this time, the sirocco fan 45 ventilates the inside of the radiator 13 using the heat-radiating fins 32 as part of a ventilation path.

Moreover, the case 16 is formed to have a substantially cylindrical shape made of a material having insulation properties such as PBT resin. Further, a partition wall part 51 is formed on a one edge side of the case 16 and on the partition wall part 51, a case communication hole 52 which allows communication between a radiator 13 side of the one edge and a cap 17 side of the other edge is opened to be formed. A cap attachment part 53 where the cap 17 is attached is formed in the middle of the one edge side and the other edge side of the case 16. On the other edge side of the case 16, a cylindrical insulation part 54 for insulating between the cap 17 and the circuit part A is formed. The insulation part 54 is provided inside the cap 17. Here, silicon series resin or the like which is a filler having heat-radiating properties and insulation properties may be filled inside the case 16 so as to recess the circuit part A.

Further, the lighting circuit of the circuit part A is, for example, a circuit for supplying constant current DC power to the LEDs 22 and includes a lighting circuit substrate and a plurality of circuit elements which are mounted on the lighting circuit substrate to configure the lighting circuit. A lead wire 47 for feeding power to the LEDs 22 from the lighting circuit side is connected to the lighting circuit part and this lead wire 47 is electrically connected to the substrate 12 via the case communication hole 52, inner space of the center axis of the sirocco fan 45, the radiator communication hole 35, and the substrate communication hole 23.

Further, the drive circuit of the circuit part A is for controlling drive of the fan motor of the air-cooling unit 15 and continuously drives the fan motor while power is supplied to the cap 17.

Further, the cap 17 is, for example an E17 type, electrically connected with the circuit part A side by a wire (not shown) and includes a tubular shell 61 having a screw thread to be screwed into a lamp socket of lighting equipment (not shown) and an eyelet 63 provided on the top of one edge side of the shell 61 via an insulation part 62.

The shell 61 is electrically connected to a power source side (not shown) and inside the shell 61, a power source wire for feeding power to the circuit part A (not shown) is sandwiched for conduction to the shell 61.

The eyelet 63 is electrically connected to ground potential (not shown) and the eyelet 63 is electrically connected to ground wire by soldering or the like which is electrically connected to the ground potential of the circuit part A.

Next, operation of an embodiment will be described.

When the self-ballasted LED lamp 11 is assembled, the other main surface 21*b* side of the substrate main body 21 of the substrate 12 on which the LEDs 22 and the like are mounted is placed on the substrate attachment surface 34 of the radiator to be fixed so that the substrate 12 and the radiator 13 are thermally connected.

The case 16 to which the air-cooling unit 15 is attached while storing the circuit part A is combined with the radiator and locked and fixed. At this time, the lead wire 47 from the circuit part A is caused to pass through the case communication hole 52, the inner space of the center axis 46 of the sirocco fan 45, the radiator communication hole 35, and the substrate communication hole 23 so that the wire is electrically connected to the substrate 12.

In a condition where the cap 17 is connected to the eyelet via the circuit part A and the earth cable, a power feeder electrically connected to the circuit part A is led out to the outside of the shell 61 and is inserted into the other edge side of the case 16 so that the power feeder is sandwiched between the case 16 and the shell 61. At this time, the case 16 and the cap 17 are locked and fixed by a convexo-concave structure or the like (not shown).

Then, an edge part of an aperture of the globe 14 covering the substrate 12 is fitted to the globe attachment part 36 of the radiator 13 and is fixed by a silicone series adhesive or the like to complete the self-ballasted lamp 11.

If the cap 17 of the self-ballasted lamp 11 thus completed is mounted on a predetermined socket and power is applied thereto, the lighting circuit is operated, power is supplied to the substrate 12 side via the wiring, each of the LEDs 22 emits light, and the emitted light is diffused and irradiated via the globe 14.

Moreover, the drive circuit is operated to supply power to the fan motor of the air-cooling unit 15 and the sirocco fan 45 of the air-cooling unit 15 is rotated. Due to rotation of the sirocco fan 45, air inside the self-ballasted lamp 11 is sucked from the center side and is discharged to the outer diameter directions so that the air is discharged from the heat-radiating hole 39 between the plurality of heat-radiating fins 32 of the radiator 13.

Therefore, heat generated from each of the LEDs 22 on the substrate 12 is mainly transmitted to the radiator 13 via the substrate attachment surface 34 to be radiated from each of the heat-radiating fins 32 of the radiator 13 by forcible blast by the sirocco fan 45.

Further, due to the rotation of the sirocco fan 45, air outside the self-ballasted lamp 11 is sucked into the inner space of the globe 14 from the ventilation holes 37 and 41 to form a flow of air that air is sucked into the sirocco fan 45 from the substrate communication hole 23 and the radiator communication hole 35 and is discharged outside. Therefore, heat radiated to the inner space of the globe 14 from each of the LEDs 22 of the substrate 12 is discharged.

Further, since air flow is generated in the order of the ventilation holes 37 and 41, the inner space of the globe 14, the substrate communication hole 23 and the radiator communication hole 35, the air-cooling unit 15, and the heat-radiating hole 39, it becomes possible to circulate outside air in the inner space of the globe 14, to increase the amount of air by the air-cooling unit 15, and to improve radiation efficiency.

Further, due to the rotation of the sirocco fan 45, it becomes possible to radiate the heat generated on the circuit part A side as well as the heat transmitted to the radiator 13 from the LEDs 22.

Thus, the air-cooling unit 15 is provided inside the radiator 13 to which a plurality of heat-radiating fins 32 are provided and part of the heat-radiating fins 32 is caused to be a ventilation path, and it becomes possible to improve the heat-radiation efficiency of the radiator 13 and to suppress a rise in temperature of the LED 22. Therefore, it becomes possible to lengthen the life of the LED 22 without lowering the brightness of the LED 22.

Further, since the ventilation filter 38 is provided to the ventilation holes 37 and 41, it becomes possible to prevent dust or insects from entering into the globe 14.

Further, the circuit part A is stored in the case 16 provided between the radiator 13 and the cap 17, thereby making it possible to easily insulate the circuit part A to the radiator 13 and at the same time to easily provide the circuit part A.

Further, using the sirocco fan 45 as the air-cooling unit 15 enables to wire the lead wire 47 connecting the circuit part A and the substrate 12 in the inner space of the rotation axis 46 of the sirocco fan 45 and therefore it becomes possible to reduce resistance to air blast by the lead wire 47.

Figure 3:
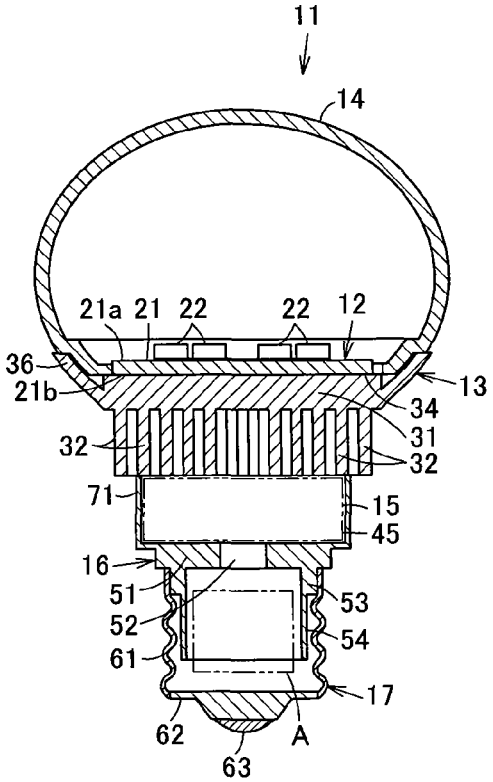
FIG. 3 is a cross-sectional view of a self-ballasted lamp showing another embodiment of the present invention.
Figure 4:
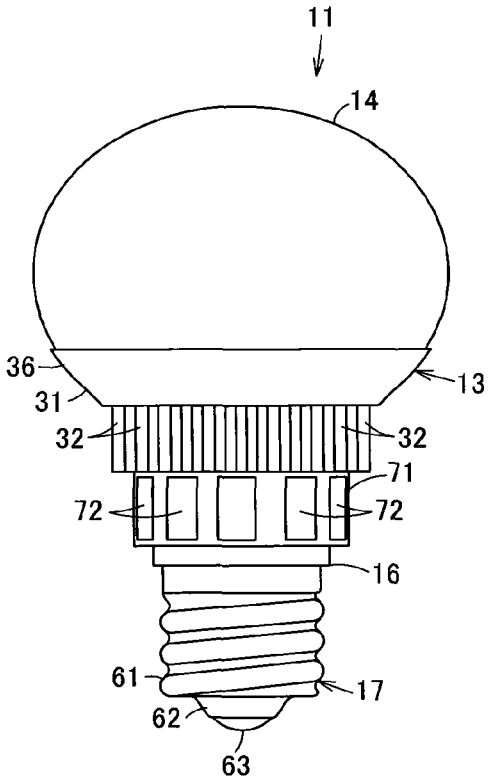
FIG. 4 is a side view of the self-ballasted lamp.

Next, FIGS. 3 and 4 show another embodiment. FIG. 3 is a cross-sectional view of a self-ballasted lamp and FIG. 4 is a side view of the self-ballasted lamp.

In the radiator 13, the plurality of heat-radiating fins 32 form a radiator-like structure where the plurality of fins 32 are separated in a reticular pattern when seen from the other edge side of the radiator 13. On the other edge side of the radiator 13, the air-cooling unit 15 stored in a fan case 71 is provided. The fan case 71 is formed integrally with the case 16 and a plurality of heat-radiating holes 72 are formed on an outer circumference surface thereof.

Moreover, the substrate communication hole 23 of the substrate 12, the radiator communication hole 35 of the radiator 13, ventilation holes 37 and 41 of the radiator 13 and the globe 14 are not provided and the space between the radiator 13 and the globe 14 is a sealed space.

Then, by the rotation of the sirocco fan 45 which is the air-cooling unit 15, air inside the self-ballasted lamp 11 is sucked from the center side, discharged in the outer diameter direction, and discharged outside from the plurality of heat-radiating holes 72 of the fan case 71. Thus, air outside the self-ballasted lamp 11 is sucked inside by the sirocco fan 45 through a space between the heat-radiating fins 32 of the radiator 13 to form a flow of air that discharges air outside.

Therefore, by the forcible blast by the sirocco fan 45, heat transmitted from each of the LEDs 22 to the radiator 13 is radiated from each of the heat-radiating fins 32 of the radiator 13.

Moreover, since the space between the radiator 13 and the globe 14 is a sealed space, it becomes possible to prevent dust included in the sucked air from entering inside the globe 14 and adhering on the LED 22 to contaminate the inside.

Figure 5:
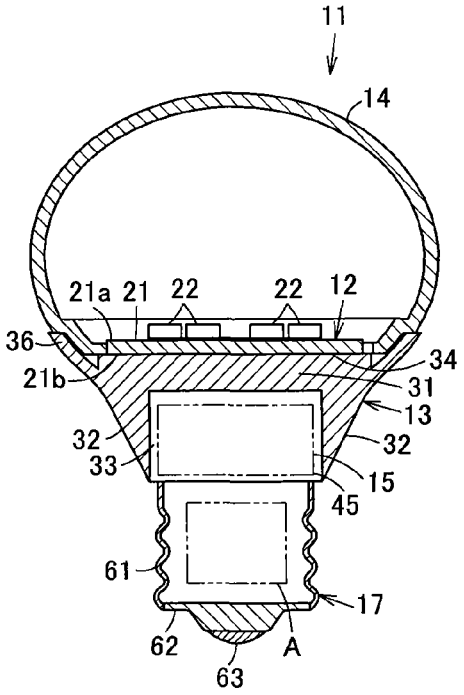
FIG. 5 is a cross-sectional view of a self-ballasted lamp showing a further embodiment of the present invention.
Figure 6:
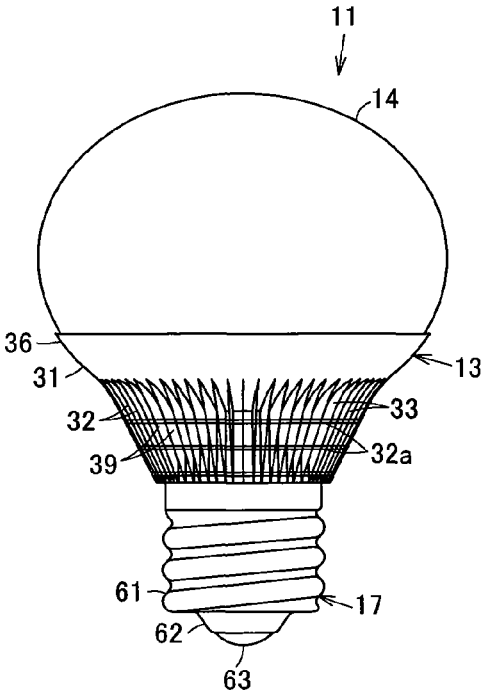
FIG. 6 is a side view of the self-ballasted lamp.

Next, FIGS. 5 and 6 show a further embodiment. FIG. 5 is a cross-sectional view of a self-ballasted lamp and FIG. 6 is a side view of the self-ballasted lamp.

The radiator 13 is formed integrally of a resin material having good insulation properties and thermal conductivity.

The case 16 for insulating the lighting circuit or the drive circuit to the radiator 13 is not used and the air-cooling unit 15 and a support mechanism supporting the lighting circuit part and the drive circuit may be integrally formed.

Moreover, the space between the radiator 13 and the globe 14 is a sealed space.

Therefore, it becomes unnecessary to insulate the lighting circuit or the drive circuit to the radiator 13 and to provide the case 16 for supporting the air-cooling unit 15, the lighting circuit part and the drive circuit. Therefore, it becomes possible to reduce the number of components and to reduce the size.

Moreover, since the radiator 13 is formed of the resin material, it becomes possible to form a complex shape. For example, it becomes possible to form a plurality of connection parts 89*a* for connecting intermediate positions of the plurality of the heat-radiating fins 32 and to improve the strength of the plurality of the heat-radiating fins 32.

Here, a temperature sensor may be provided in the self-ballasted lamp 11 and the fan motor may be driven only when the temperature detected by the temperature sensor becomes a predetermined temperature or higher.

Figure 7:
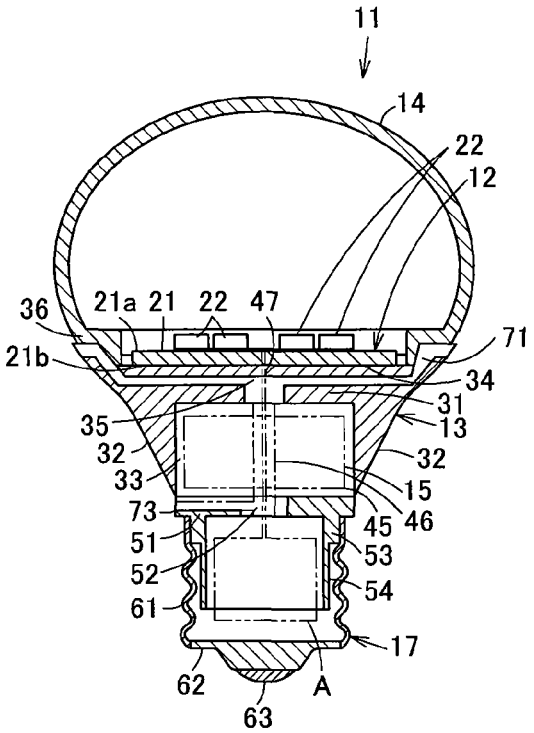
FIG. 7 is a cross-sectional view of a self-ballasted lamp showing an embodiment of the present invention.
Figure 8:
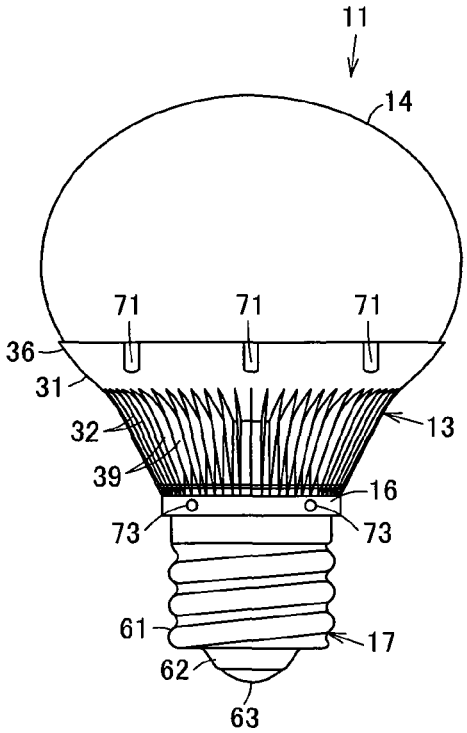
FIG. 8 is a side view of the self-ballasted lamp.

Next, FIGS. 7 and 8 show an embodiment. FIG. 7 is a cross-sectional view of a self-ballasted lamp and FIG. 8 is a side view of the self-ballasted lamp.

A plurality of ventilation holes 71 are provided in the circumferential direction at equal intervals on the one edge side of the radiator main body part 31. The ventilation holes 71 are facing the edge part of the globe 14 and communicating with the radiator communication hole 35 of the radiator 13 so as to allow discharged air to directly hit the globe 14.

Moreover, a plurality of suction holes 73 which communicate with the case communication hole 52 and suck outside air are formed in the periphery of the partition wall part 51 of the case 16.

The sirocco fan 45 sucks air from the ventilation hole 73 into the self-ballasted lamp 11 and discharges air from the communication hole 71 via the radiator communication hole 35 so that the discharged air hits the globe surface.

Next, operation of the above embodiment will be described.

When the self-ballasted lamp 11 is assembled, the case 16 which stores the circuit part A and to which the air-cooling unit 15 is attached is combined with the radiator 13 to be locked and fixed. At this time, a lead wire from the circuit part A is wired through the case communication hole 52, the inner space of the center axis 46 of the sirocco fan 45, and the radiator communication hole 35 to electrically connect the circuit part A to the substrate 12.

Then, an edge part of an aperture of the globe 14 is fitted to the globe attachment part 36 of the radiator 13 so as to cover the substrate 12 so that the space inside the globe 14 is sealed and the edge part is fixed by a silicon series adhesive or the like to complete the self-ballasted lamp 11.

Moreover, the drive circuit is operated to supply power to the fan motor of the air-cooling unit 15 and the sirocco fan 45 of the air-cooling unit 15is rotated. Due to the rotation of the sirocco fan 45, outside air is sucked in from the ventilation hole 73 and is discharged to directly hit the globe 14 from the ventilation hole 73 through the case communication hole 52 which communicates with the ventilation hole 73 and the radiator ventilation hole 35 and via the ventilation hole 71. Due to such a flow of outside air, air warmed by cooling the plurality of heat-radiating fins 32 of the radiator 13 and the globe 14 is discharged outside. Therefore, heat generated from each of the LEDs 22 on the substrate 12 is mainly transmitted to the radiator 13 via the substrate attachment surface 34 and is efficiently radiated from each of the heat-radiating fins 32 of the radiator 13 by the forcible blast by the sirocco fan 45 from a low-temperature area to a high-temperature area in the axial direction that is from the cap 17 of the self-ballasted lamp 11 to the globe 14.

Further, due to the rotation of the sirocco fan 45, air outside the self-ballasted lamp 11 is discharged outside from the suction hole 73 formed in the low-temperature area on the cap 17 side so as to directly hit an external surface of the globe 14. Since the outside air is discharged to the external surface of the globe 14, which stores a heat source which is lighting and has a high temperature, it becomes possible to efficiently carry out air-cooling.

Thus, the air-cooling unit 15 is provided inside the radiator 13 to which the plurality of heat-radiating fins 32 are provided and at the same time air is discharged so that the discharged air directly hits the external surface of the globe 14. Therefore, it becomes possible to efficiently radiate the globe 14 in the high-temperature area and to improve the heat-radiation efficiency of the self-ballasted lamp 11. Therefore, it becomes possible to lengthen the life of the LED 22 without decreasing the brightness of the LED 22.

Figure 9:
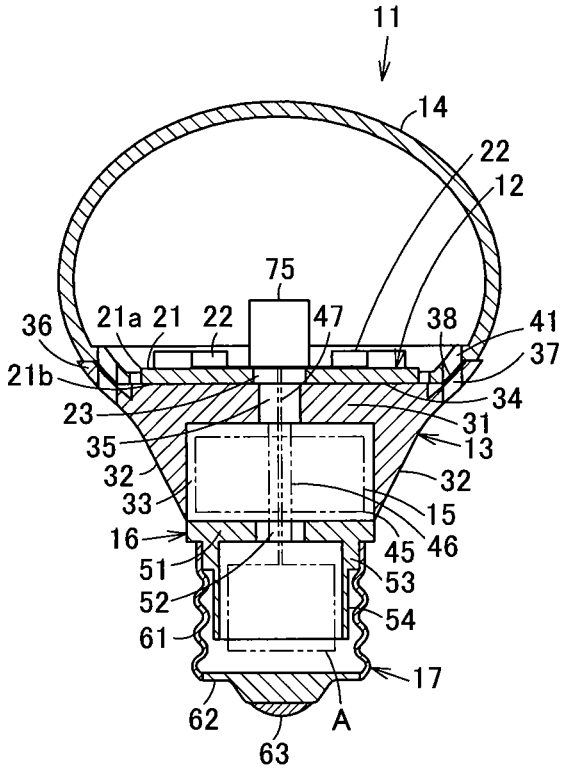
FIG. 9 is a cross-sectional view of a self-ballasted lamp showing another embodiment of the present invention.

Next, an embodiment is shown in FIG. 9. FIG. 9 is a cross-sectional view of the self-ballasted lamp. Here, the same reference numerals are given to the components having same configuration as those in the above-mentioned embodiments and description thereof is omitted.

At the substantial center of the substrate main body 21, a drive circuit 75 for rotation-driving the sirocco fan 45 is provided, so that the drive circuit 75 is surrounded by a plurality of, for example, eight LEDs 22 which are light emitting elements mounted on the one main surface 21*a* side which is one edge side of the substrate main body 21 of the substrate 12. A drive axis extending from the drive circuit 75 extends downward via the substrate communication hole 23 at the center of the substrate 12 and is connected to the center axis 46 of the sirocco fan 45.

The drive circuit 75 mounted in the center area of the substrate main body 21 is for controlling drive of the fan motor of the air-cooling unit 15 and continuously drives the fan motor while energized by the substrate 12.

In the self-ballasted lamp 11 of the present embodiment, in addition to the effect of the self-ballasted lamp 11 of the above-mentioned embodiments, heat is transmitted to the radiator 13 via the substrate attachment surface 34 and the heat is efficiently radiated from each of the heat-radiating fins 32 of the radiator 13 by the forcible blast by the sirocco fan 45 since the LED 22 which is a major heat source during lighting and the drive circuit 75 of the fan motor are mounted on the substrate main body 21 and stored in the globe 14 as a whole. Moreover, in the case of one having a small space in the cap 17, for example, a case of the E17 cap type, size of the radiator is not reduced and size of the self-ballasted lamp 11 can be reduced as a whole while maintaining a heat-radiation effect.

Figure 10:
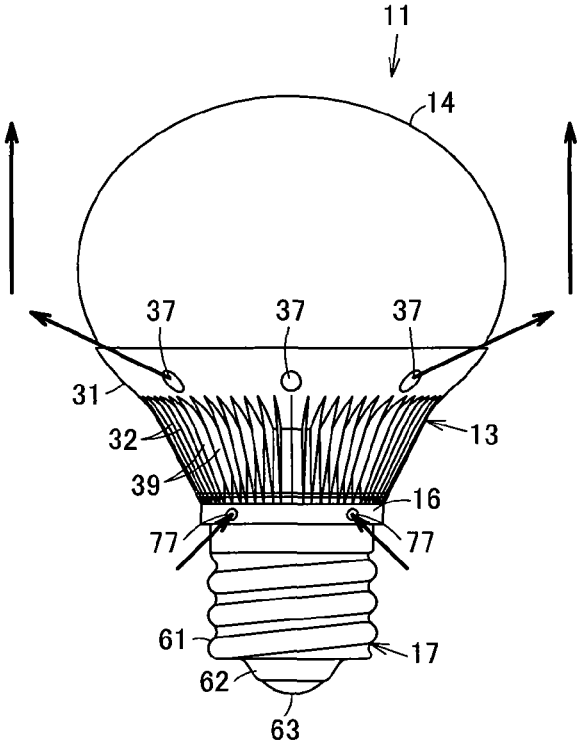
FIG. 10 is a view showing a frame format of a path of air in a self-ballasted lamp showing a further embodiment of the present invention.

Next, a further embodiment is shown in FIGS. 10 and 11. FIG. 10 is a view schematically showing a flow path of air in the self-ballasted lamp, and FIG. 11 is a view schematically showing a flow path of a self-ballasted lamp when an upper side of the cap is lit.

The self-ballasted lamp 11 shown in FIG. 10 is connected to a socket of lighting equipment and is supplied with power with the cap 17 facing downward.

Then, the circuit part A is operated and power is supplied to the substrate 12 to light each of the LEDs 22 and at the same time an acceleration sensor (not shown) which is stored in the cap 17 and provided to the circuit part A detects the positional relationship of the cap 17 to start operation of the drive circuit. In a case where the LEDs 22 are lit while the cap 17 faces downward, the sirocco fan 45 of the air-cooling unit 15 carries out a positive rotation. Thus, air is sucked in from the outside from the cap 17 side via a communication hole 77 which is formed in the periphery of the partition wall part 51 of the case 16 and communicating with the case communication hole 52. The sucked air passes through the inner space of the radiator 13 and is discharged toward the globe 14 side. The warm air thus discharged is released upward due to the convection by the self-ballasted lamp 11 which becomes a high temperature during lighting. Therefore, it becomes possible to suppress sucking the warm air, which is discharged, again. Thus, the heat-radiating fins 32 always radiate and are cooled while the LED 22 is lit and at the same time, the warm air once discharged is not sucked again. Therefore, it becomes possible to increase the lowering effect of the LED temperature and to increase the light emitting effect of the LED 22.

Meanwhile, the self-ballasted lamp 11 shown in FIG. 11 is connected to the socket of the lighting equipment to be supplied with power while the cap 17 faces upward.

Then, when the self-ballasted lamp 11 is turned on, the acceleration sensor stored in the cap 17 detects the positional relationship of the cap 17 and reverse rotation of the sirocco fan 45 of the air-cooling unit 15 is carried out. Then, air is sucked from the ventilation holes 37 and 41 on the globe 14 side and the air passes through the inner space of the radiator 13 to be discharged from the communication hole 77 side on the cap 17 side. Due to the heat generated during lighting, air in the periphery of the self-ballasted lamp 11 convects from the lower to the upper side. Therefore, it becomes possible to prevent warm air discharged once from being sucked again and to carry out lowering of the LED 22 temperature efficiently.

Figure 12:
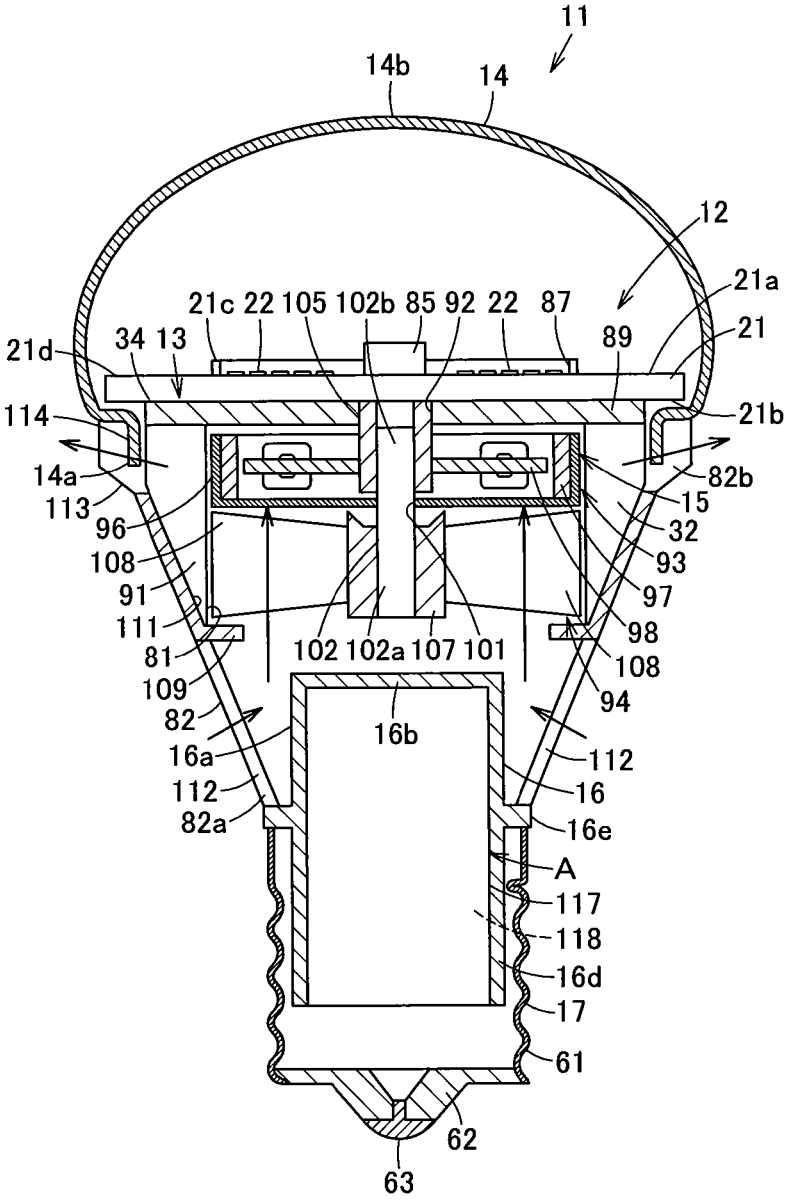
FIG. 12 is a longitudinal-sectional view of a self-ballasted lamp showing an embodiment of the present invention.
Figure 13:
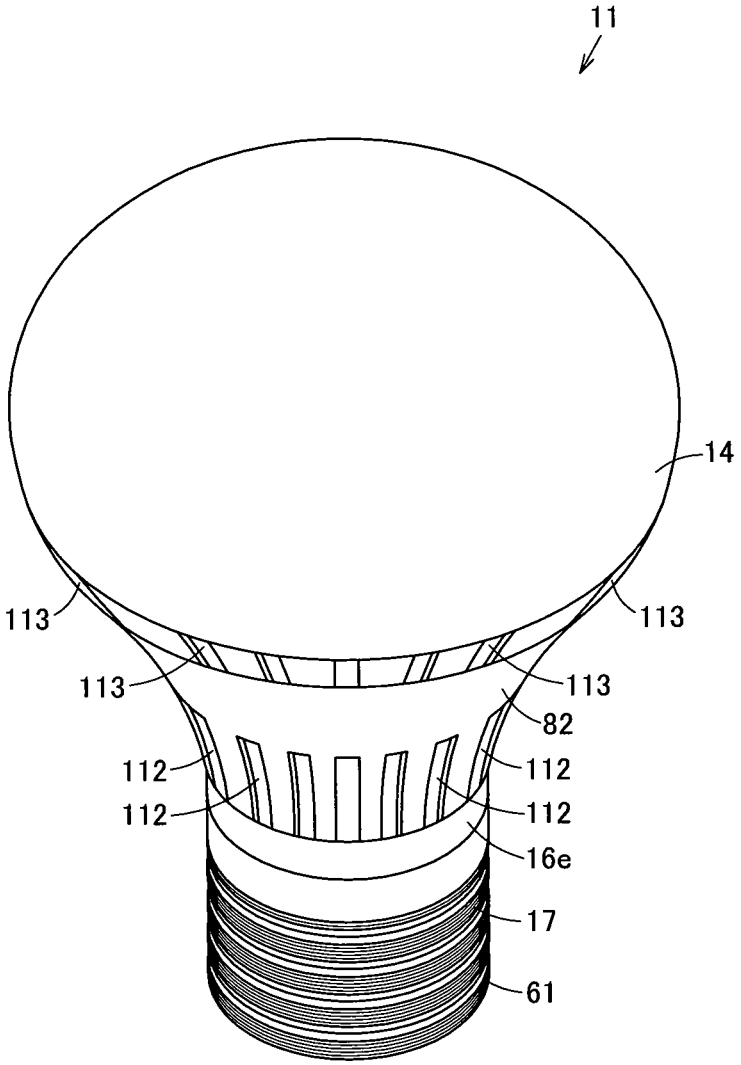
FIG. 13 is an external view of the self-ballasted lamp.

Next, FIGS. 12 and 13 show another embodiment. FIG. 12 is a longitudinal-sectional view of a self-ballasted lamp and FIG. 13 is an external view of the self-ballasted lamp.

As shown in FIGS. 12 and 13, a storage part 81 having a concave shape is provided to the other edge side of the radiator 13 and the air-cooling unit 15 is stored in the storage part 81. The radiator 13 is provided in a main body case 82, which is hollow and substantially cylindrical, with the air-cooling unit 15 and the globe 14 attached to a one edge side of the main body case 82 while covering the substrate 12. To the other edge side of the main body case 82, the case 16 storing the circuit part A is attached and the cap 17 is attached to the case 16. Then, this self-ballasted LED lamp 11 has the same length as that of a mini krypton lamp.

On the one main surface 21*a* side which is the one edge side of the substrate main body 21 of the substrate 12, the LED 22 and a drive circuit 85 which is for driving the air-cooling unit 15 are mounted.

The other main surface 21*b* which is the other edge side is in contact with the radiator 13 to cause the substrate main body 21 to be thermally connected to radiator 13. Moreover, a connector receiving part (not shown) to allow the substrate main body 21 to be electrically connected to the air-cooling unit 15 and the circuit part A side is provided to the substrate main body 21.

Further, the LEDs 22 are provided on one same circumference with the center position of the substrate main body 21 as its center in a manner that they are separated from each other at substantially equal intervals and are surrounded by a casing part 21*c* protruding like circumferential rib from the one main surface 21*a* of the substrate main body 21. That is, a provision area 87 having a circular shape when seen planarly where the LEDs 22 are provided is partitioned and formed inside the casing part 21*c*.

The drive circuit 85 is a circuit for supplying DC power to the air-cooling unit 15 and includes a plurality of elements (not shown). Moreover, the drive circuit 85 is provided at the substantially center portion of the one main surface 21*a* of the substrate main body 21. In other words, the drive circuit 85 is provided at a position farthest from each of the LEDs 22 on the one main surface 21*a* of the substrate main body 21. Here, the drive circuit 85 may operate to drive the air-cooling unit 15 all the time if the LEDs 22 are turned on or may operate to drive the air-cooling unit 15 appropriately only when required, such as when the temperature of the LEDs 22 detected by a temperature detection unit or the like becomes a predetermined temperature or higher.

The connector receiving part is a terminal which is electrically connected to each of the LEDs 22 and the drive circuit 85, that is, a connector wafer (connector base). Here, the connector receiving part may be provided on either the one main surface 21*a* or the other main surface 21*b* of the substrate main body 21. However, it is preferable that the connector receiving part is provided on the one main surface 21*a*.

On the radiator 13, one edge part (upper edge part) of the plurality of heat-radiating fins 32 is connected to a connection part 89 having a substantially circular shape when seen planarly and the storage part 81 is partitioned inside the heat-radiating fins 32.

The heat-radiating fins 32 are formed to have a protrusion which becomes gradually larger in the diameter direction from the other edge side to the one edge side of the radiator 13. Moreover, each of these heat-radiating fins 32 is respectively formed at a position of the outer circumference of the connection part 89 and is formed at substantially equal intervals between each other in the circumferential direction of the radiator 13. Therefore, between the heat-radiating fins 32, a ventilation part 91 communicating with the storage part 81 is formed.

The connection part 89 has a smaller diameter than the substrate main body 21 and has a larger diameter than that of the casing part 21*c* of the substrate main body 21 (the provision area 87). Moreover, an upper surface of the connection part 89 is the above-mentioned smoothly formed substrate attachment surface 34 and the substrate attachment surface 34 is in close contact with the other main surface 21*b* of the substrate main body 21 to be thermally connected thereto. Therefore, the radiator 13 is in contact with the substrate main body 21 at least at a position that overlaps the position of the LEDs 22 of the substrate main body 21 when seen planarly and the substrate main body 21 protrudes externally from the substrate attachment surface 34 in an outer circumference edge part 21*d* which is at a more outer position than the LEDs 22 on the substrate main body 21.

The storage part 81 is a storage space for storing the air-cooling unit 15 inside and is formed from a lower edge of the radiator 13 to an upper edge side and is positioned to a spot which corresponds to a back surface side of the provision area 87. Moreover, the width dimension (diameter dimension) of the storage part 81 is formed a little larger than the diameter dimension of the casing part 21*c* of the substrate main body 21 (provision area 87). Further, the storage part 81 communicates with the substrate attachment surface 34 due to an attachment hole part 92 formed at the substantially center part of the connection part 89. In other words, the other surface 21*b* on the back surface side of the drive circuit 85 of the substrate main body 21 is exposed to the storage part 81 side from this attachment hole part 92.

The air-cooling unit 15 includes a motor 93 and a fan 94 rotation-driven by the motor 93 as one unit.

The motor 93 is an outer rotor type DC motor rotation-driven by power supplied from the drive circuit 85 and includes a yoke 96 having a substantially cylindrical shape with a bottom, which forms an external shape, a permanent magnet 97 provided on an inner circumference surface of the yoke 96 and has a substantially cylindrical shape, and an armature 98 provided on an inner circumference surface of the permanent magnet 97. Then, the motor 93 is slightly separated from a lower part of the connection part 89 of the radiator 13 to face thereto and is separated from the other main surface 21*b* of the substrate main body 21 by a predetermined distance, for example, 1 mm or more.

The yoke 96 becomes a rotor, is formed of a metallic material having magnetic characteristics, and a rotation axis 102 is press fitted in a hole part 101 opened at the substantially center portion of the bottom surface.

In the rotation axis 102, the fan 94 is connected to a one edge 102*a* side and the other edge 102*b* side is inserted into an axis receiving part 105 having a substantially cylindrical shape, which is press fitted to the attachment hole part 92 of the radiator 13, and is rotatably supported.

The axis receiving part 105 includes a bearing or the like (not shown) inside and an upper edge part which is a one edge side is brought into contact with the other main surface 21*b* of the substrate main body 21 while a lower edge side which is the other edge side is inserted into the yoke 96 and is separated from the bottom part of the yoke 96.

Moreover, the permanent magnet 97 includes a north pole area and a south pole area alternately in the circumferential direction, is attracted by the yoke 96, and is rotatably configured integrally with the yoke 96.

A coil (not shown) or the like is wound around the rotor 98 to form an electromagnet so that a stator pole having a plurality of north and south pole areas alternately on an outer circumference side and facing the permanent magnet 97 is formed. The rotor 98 is fixed to the axis receiving part 105.

Meanwhile, the fan 94 is an axial flow fan including a substantially cylindrical fan center part 107 connected to a rotation axis 102 of the motor 93 and a plurality of fan parts 108 protruding in the diameter direction from the fan center part 107. Then, the fan 94 faces the lower part of the yoke 96. Therefore, in the air-cooling unit 15, the motor 93 and the fan 94 are provided in this order from the substrate main body 21 side to the lower side. In other words, the motor 93 for the air-cooling unit 15 is provided between the substrate main body 21 and the fan 94.

The plurality of fan parts 108 are formed in the circumferential direction and are configured to flow air from the lower to the upper side along the axial direction of the fan 94 by rotation of the fans. Moreover, an outer circumference of the fan parts 108 is positioned in the vicinity of the inner circumference of the storage part 81. Therefore, the fan parts 108 are formed so as to allow a part having a larger flow rate density to be positioned on the back surface side of the position where the LEDs 22 are provided. In other words, the fan parts 108 are provided in a manner that the flow rate density of a part corresponding to the provision area 87 of the LEDs 22 when seen planarly becomes large.

Further, the main body case 82 is formed of a material having good heat-radiation properties and is formed in a manner that the diameter thereof becomes gradually larger from the lower edge part which is the one edge 82*a* side to the upper edge side which is the other edge 82*b* side. Further, at substantially center positions on both edges in the axial direction (vertical direction) of the main body case 82, support parts 109 for supporting the radiator 13 from the lower side are formed in a protruding manner toward the center axis side. Therefore, in the main body case 82, a radiator storage space 111 for storing the radiator 13 is partitioned on an upper side of the support parts 109, that is, on the other edge 82*b* side. Further, on an outer circumference surface of the main body case 82, a plurality of intake ports 112 are opened and formed in the circumferential direction separating from each other at a position on the one edge 82*a* side of the support part 109. Further, on an outer circumference surface of the other edge 82*b* of the main body case 82, a plurality of discharge outlets 113 are formed in the circumferential direction. Each of the discharge outlets 113 are separated from each other. Then, on an inner circumference side of the other edge 82*b* of the main body case 82, an attachment concave portion 114 for attaching the globe 14 is formed.

The support part 109 is formed to be substantially horizontal and is formed, for example, continuously along the entire circumference of the main body case 82 in a circular pattern.

The radiator storage space 111 is formed so as to allow an inner circumference surface of the main body case 82 to come into close contact with the outer circumference surface of the heat-radiating fins 32 of the radiator 13 with no space therebetween.

The intake ports 112 are apertures for sucking outside air by the rotation of the fan 94 of the air-cooling unit 15 into the main body case 82. The intake ports 112 have a long hole shape that follows the axial direction of the main body case 82 and are formed in the circumferential direction of the main body case 82 while being separated from each other at substantially equal intervals. Therefore, the intake ports 112 are formed to suck outside air from the lower side which is the one edge 82*a* side of the main body case 82 to the upper side.

The discharge outlets 113 are apertures for discharging the air sucked into the main body case 82 by the rotation of the fan 94 of the air-cooling unit 15 to the outside via the storage part 81 and the ventilation part 91 inside the radiator 13 and face the outer circumference surface of the heat-radiating fins 32. The discharge outlets 113 are formed in the circumferential direction of the main body case 82 while being separated from each other at substantially equal intervals. Therefore, these discharge outlets 113 are formed to discharge air from the other edge 82*b* side of the main body case 82 to an upper direction. Therefore, the direction from which the air-cooling unit 15 sucks air and the direction to which air is discharged differ from each other, for example, the directions are mutually orthogonal. Moreover, the discharge outlets 113 are formed at positions corresponding to each of the intake ports 112 toward the circumferential direction of the main body case 82. Here, the discharge outlets 113 may be formed at a position off from the intake ports 112 with respect to the circumferential direction of the main body case 82 and then umber of discharge outlets 113 maybe different from that of the intake ports 112.

Moreover, the one edge 14*a* of the globe 14 is attached to the attachment concave portion 114 of the main body case 82, the globe 14 is positioned on the one edge side of the radiator 13, and is continued to the other edge 82*b* of the main body case 82. Further, the globe 14 is formed so as to allow the diameter thereof to gradually increase from the one edge 14*a* side and to be gradually reduced from the maximum diameter position to the other edge side 14*b*. The maximum diameter position is in a more upward position than any of the LEDs 22 of the substrate 12.

Further, the circuit part A includes a lighting circuit substrate 117 which is plate-shaped lighting equipment main body and a plurality of circuit elements (not shown) which are mounted on the lighting circuit substrate 117 to configure a lighting circuit 118 and is stored in the case 16 along the axial direction.

The lighting circuit 118 is a circuit for supplying, for example, constant current to the LEDs 22 and is electrically connected to the substrate 12 via wiring (not shown).

The one edge 16*a* side of the case 16 is closed by a closing plate 16*b* which is a case closing part as the partition wall part and a communication hole communicating with the inside of the main body case 82 (not shown) is opened and formed on the closing plate 16*b*. Further, on an outer circumference surface of the medium part between the one edge 16*a* side and the other edge 16*d* side of the case 16, a flange portion 16*e* as an insulation part for insulating between the radiator 13, the main body case 82 and the cap 17 is continuously formed in the whole of the circumferential direction while protruding in the diameter direction. Here, inside the case 16, silicon series resin or the like having heat-radiation properties and insulation properties may be filled so as to recess the circuit part A.

The cap 17 is positioned on the other edge 16*d* side of the case 16, that is, on the other edge side of the radiator 13.

Next, operation of the above-mentioned embodiment will be described.

When the self-ballasted LED lamp 11 is assembled, the one edge 102*a* of the rotation axis 102 is press fitted into the axis receiving part 105 to unitize the motor 93 and the fan 94 of the air-cooling unit 15. Then, the axis receiving part 105 is press fitted into the attachment hole part 92 to store and fix the air-cooling unit 15 into the storage part 81 of the radiator 13.

Next, the radiator 13 to which the air-cooling unit 15 is fixed is mounted on the support part 109 of the main body case 82 and is fixed, the other main surface 21*b* side of the substrate main body 21 of the substrate 12 mounting the LEDs 22, the drive circuit 85, and the like is mounted on the substrate attachment surface 34 of the radiator 13 exposed from the main body case 82, and the substrate 12 and the radiator 13 are thermally connected.

Moreover, the one edge 16*a* side of the case 16 storing the circuit part A is inserted into the one edge 82*a* of the main body case 82 and is fixed by a convexo-concave structure or the like (not shown). At this time, a cable connected to an output side of the lighting circuit substrate 117 (lighting circuit 118) of the circuit part A is electrically connected to the substrate main body 21 side.

Subsequently, the cap 17 to which the eyelet 63 is connected via the circuit part A and an earth cable is inserted from the other edge 16*d* side of the case 16 while a power feeder electrically connected to the circuit part A side is led out to the outside of the shell 61 so that the power feeder is sandwiched between the case 16 and the shell 61. At this time, the case 16 and the cap 17 are locked and fixed by a convexo-concave structure or the like (not shown).

Then, the one edge 14*a* side of the globe 14 is fitted into the attachment concave portion 114 of the main body case 82 so as to fix the globe 14 to the main body case 82. The fixed portion is enforced by a silicon series adhesive or the like to complete the self-ballasted LED lamp 11.

The cap 17 of the self-ballasted LED lamp 11 thus completed is mounted on a predetermined socket and if power is fed, the lighting circuit 118 of the circuit part A is operated. Then, power is supplied to the substrate 12 side, each of the LEDs 22 emits light, and the emitted light is diffused and irradiated via the globe 14 without being blocked by the drive circuit 85 or the like.

Moreover, heat generated from each of the LEDs 22 on the substrate 12 is transmitted to the radiator 13 via the substrate attachment surface 34 to be radiated from each of the heat-radiating fins 32 of the radiator 13.

At this time, due to the DC power supplied from the drive circuit 85 to the motor 93, a coil of the armature 98 is energized and a plurality of both north and south poles are formed alternately on the outer circumference of the armature 98 so that the yoke 96, which attracts the permanent magnet 97 and has an inner circumference side facing the outer circumference of the armature 98, is rotated in the circumferential direction with the rotation axis 102 and the fan 94 is rotation-driven in the circumferential direction.

As a result thereof, outside air is sucked from the intake port 112 into the main body case 82 from the lower to the upper direction by the effect of a negative pressure caused by the rotation of the fan 94. The sucked air passes through the fan 94 in the axial direction, is blown onto the back surface of the connection part 89 of the radiator 13, flows in a diameter direction via the ventilation part 91, and is discharged from the discharge outlet 113 to outside of the main body case 82 from the lower to the upper direction.

Then, by the forcible air blast by the air-cooling unit 15, heat generated from the LEDs 22 is forcibly cooled down via the radiator 13.

As described above, the one edge side of the radiator 13 is brought into close contact with the other main surface 21*b* of the substrate main body 21 having the LEDs 22 on the one main surface 21*a* and the air-cooling unit 15 is stored in the storage part 81 inside the radiator 13 while the drive circuit 85 for driving the air-cooling unit 15 is provided to the substrate main body 21. Thus, it becomes unnecessary to provide a space respectively for storing the air-cooling unit 15 and the drive circuit 85 in the main body case 82 or the like. Therefore, it becomes possible to provide the air-cooling unit 15 and the drive circuit 85 while saving a space and to respond to size reduction of the equipment while ensuring a cooling effect.

Moreover, the motor 93 is provided between the substrate main body 21 and the fan 94 provided to face the other main surface 21*b* side of the substrate main body 21 and the motor 93 is attached to the radiator 13 by press fitting the axis receiving part 105 to the attachment hole part 92 of the radiator 13. Therefore, it becomes possible to blow wind by the rotation of the fan 94 to the motor 93 to cool down the motor 93. Thus, the cooling effect is improved and a space for axially supporting the motor 93 can be suppressed because the motor 93 does not need to be newly axially supported in the main body case 82. Therefore, size of the self-ballasted lamp 11 can be reduced more and the motor 93 can be provided nearer to the drive circuit 85 to suppress the wiring distance between the drive circuit 85 and the motor 93 and to improve mountability.

Then, providing the drive circuit 85 on the one main surface 21*a* side of the substrate main body 21 enables the other surface 21*b* side of the substrate main body 21 to be flat and to be in close contact with the radiator 13. Therefore, it becomes possible to radiate more efficiently.

Moreover, since the air-cooling unit 15 is fixed to the radiator 13, it becomes possible to thermally connect the substantially whole surface of the other main surface 21*b* side of the substrate main body 21 to the radiator 13 and therefore thermal conductivity to the radiator 13 can be further improved.

Further, since the axis receiving part 105 is press fitted into the attachment hole part 92 in the substantially center portion of the radiator 13, it becomes easy to apply the axis receiving part 105 to the self-ballasted LED lamp 11 which is generally rotationally-symmetric to the optical axis.

Further, since the motor 93 and the fan 94 are unitized for the air-cooling unit 15, mountability thereof is fine.

Further, since the substrate main body 21 and the motor 93 are separated for a predetermined distance or more, the connection part 89 of the radiator 13 can be provided between the substrate main body 21 and the motor 93. Therefore, contact area between the other main surface 21*b* of the substrate main body 21 and the radiator 13 can be maximally ensured and the cooling effect can be further improved.

Further, taking the flow speed of air by the fan 94 into consideration, flow rate density is not uniform and the flow rate density at a position which faces the fan parts 108 becomes larger. Therefore, in a case where the LEDs are provided in the center part, heat which has become high at the center part is moved to the position facing the fan parts 108 and cooled. In such a case, it is not easy to improve cooling efficiency. However, since the LEDs 22 are provided at a position facing the fan parts 108, cooling efficiency can be further improved.

Then, ensuring the cooling effect as mentioned above, temperature of the LEDs 22 can be reduced, a highly effective self-ballasted lamp 11 can be provided, and life of the LEDs 22 can be lengthened.

Figure 14:
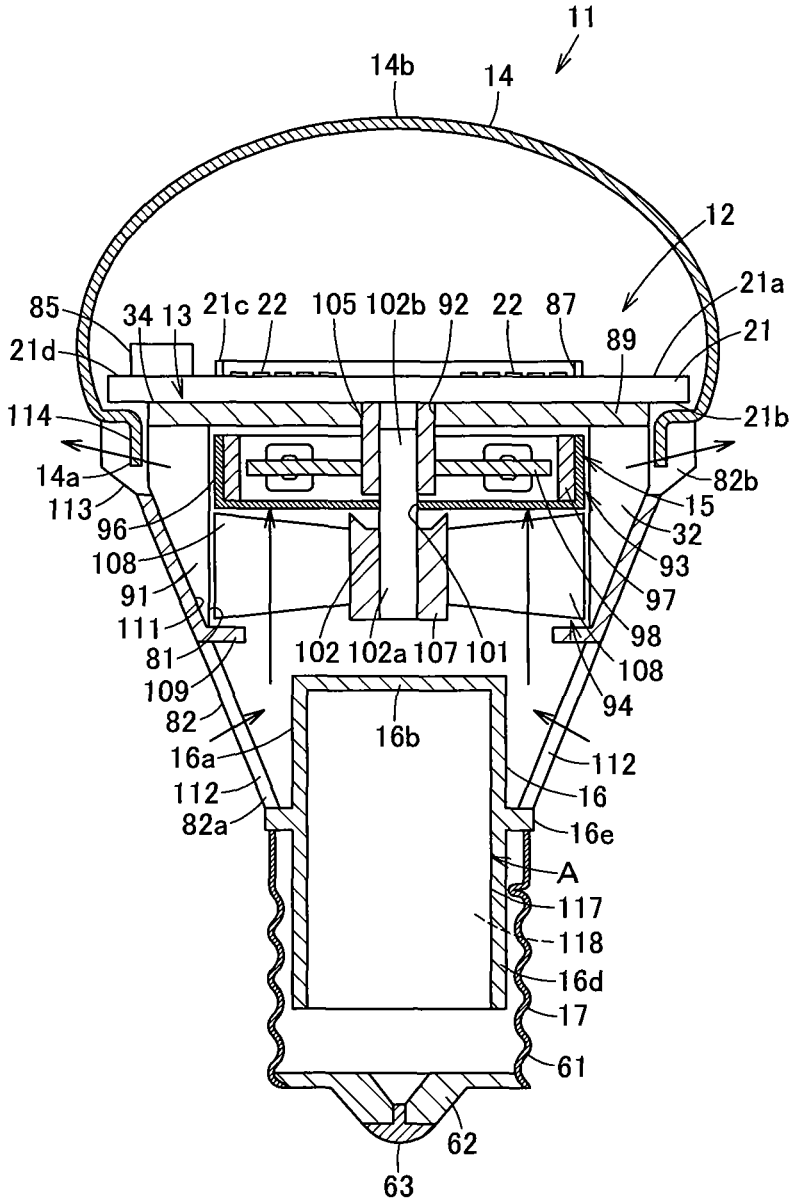
FIG. 14 is a longitudinal-sectional view of a self-ballasted lamp showing an eighth embodiment of the present invention.

Next, an embodiment is shown in FIG. 14. FIG. 14 is a longitudinal-sectional view of a self-ballasted lamp. Here, the same reference numerals are given to the components having same configuration and actions as those in the above-mentioned embodiment and description thereof is omitted.

In this embodiment, the drive circuit 85 in the above-mentioned embodiment is provided on the outer circumference edge part 21*d* of the one main surface 21*a* of the substrate main body 21, that is, outside of the casing part 21*c* (provision area 87). Here, the drive circuit 85 may be provided in a circular manner (circularly or annularly) along the circumferential direction of the casing part 21*c* as long as the drive circuit 85 is provided outside the casing 21*c*.

Moreover, the drive circuit 85 is provided so as to overlap the outer circumference side of the heat-radiating fins 32 of the radiator 13 when seen planarly.

Then, having the configuration similar to that of the seventh embodiment such as the one edge side of the radiator 13 is brought into close contact with the other main surface 21*b* of the substrate main body 21 having the LEDs 22 on the one main surface 21*a* and the air-cooling unit 15 is stored in the storage part 81 inside the radiator 13 while the drive circuit 85 for driving the air-cooling unit 15 is provided to the substrate main body 21 enables to obtain an effect similar to that of the above-mentioned embodiment.

Figure 15:
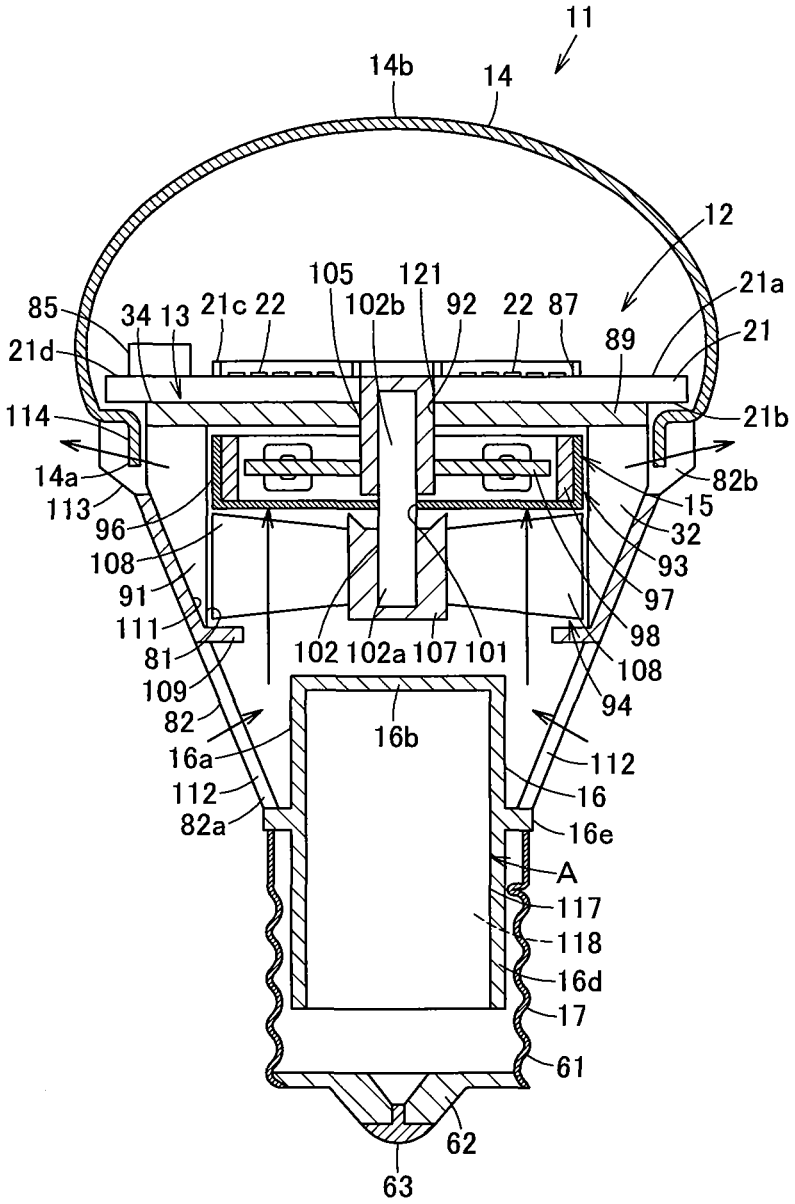
FIG. 15 is a longitudinal-sectional view of a self-ballasted lamp showing a further embodiment of the present invention.

Next, a further embodiment is shown in FIG. 15. FIG. 15 is a longitudinal-sectional view of a self-ballasted lamp. Here, the same reference numerals are given to the components having the same configuration and actions as those in each of the above-mentioned embodiments and description thereof is omitted.

In the further embodiment, the axis receiving part 105 of the air-cooling unit 15 in the above-mentioned embodiment is inserted into the attachment hole part 92 of the radiator 13 and is press fitted into an aperture 121 opened and formed in the substantially center portion of the substrate main body 21.

That is, the aperture 121 is formed at a position facing the attachment hole part 92 and has a round hole shape with a diameter which is substantially the same as that of the attachment hole part 92. Therefore, the aperture 121 is formed at a position farthest from the LEDs 22 and inside the casing part 21*c* (provision area 87) and penetrates the substrate main body 21 in the thickness direction. Here, the aperture 121 may not penetrate the substrate main body 21 in the thickness direction and instead may be provided on the other main surface 21*b* side as a recessed portion.

Then, the air-cooling unit 15 includes the motor 93 and the fan 94 and the axis receiving part 105 is inserted into the attachment hole part 92 of the radiator 13 so as to be press fitted into the aperture 121 of the substrate main body 21. Thus, it becomes unnecessary to newly axis support the air-cooling unit 15 in the main body case 82 and therefore it becomes possible to ensure sufficient space inside the main body case 82 and to reduce the size of the self-ballasted lamp 11.

Moreover, since the axis receiving part 105 is press fitted into the aperture 121 of the substrate main body 21 from the other main surface 21*b* side which is the opposite side to the one main surface 21*a* where the LEDs 22 and the drive circuit 85 are mounted, whole of the other surface 21*b* of the substrate main body 21 except for the aperture 121 can be brought into close surface contact with the radiator 13 in a planar state to be thermally connected. Therefore, it becomes possible to further improve thermal conductivity to the radiator 13.

Figure 16:
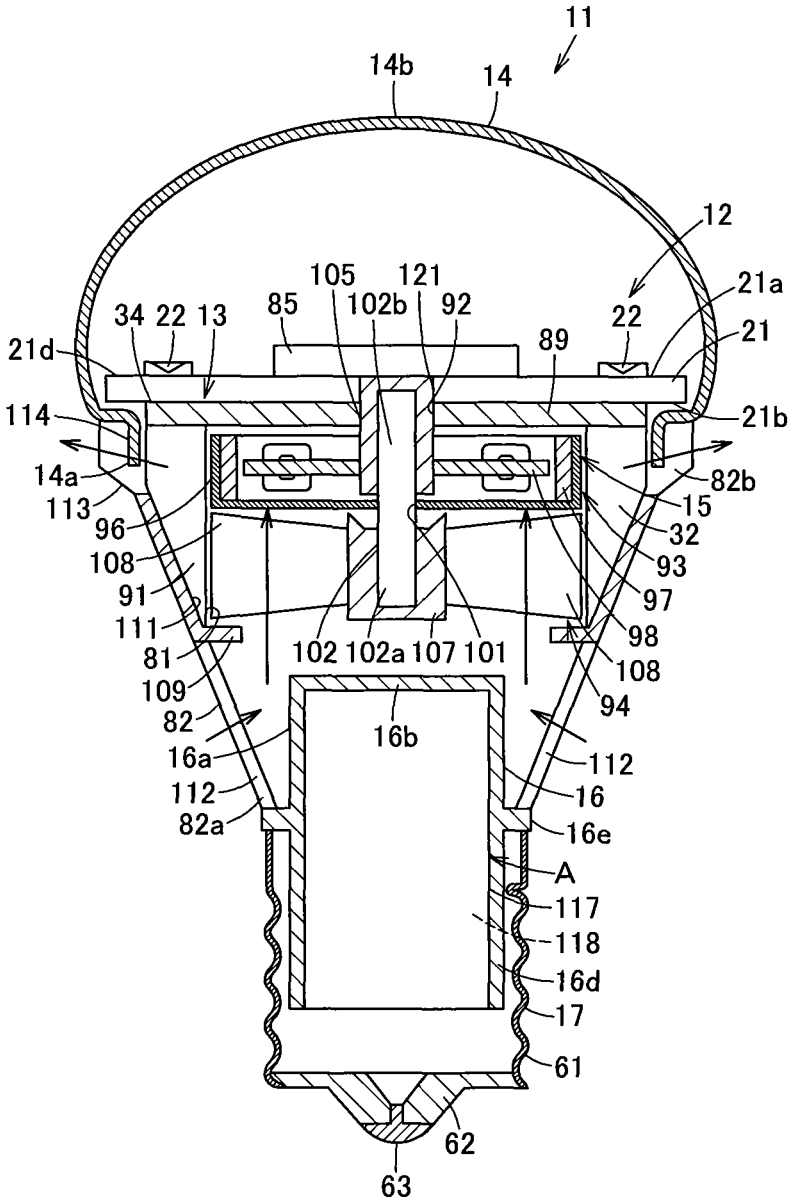
FIG. 16 is a longitudinal-sectional view of a self-ballasted lamp showing a another embodiment of the present invention.

Next, another embodiment is shown in FIG. 16. FIG. 16 is a longitudinal-sectional view of a self-ballasted lamp. Here, same reference numerals are given to the components having same configuration and actions as those in each of the above-mentioned embodiments and description thereof is omitted.

In the embodiment, the LEDs 22 in the above-mentioned ninth embodiment are provided along one same circumference at a position in the vicinity of the outer circumference of the substrate main body 21 and the drive circuit 85 is provided on the center side of the substrate main body 21 except for the aperture 121, that is, at a position inside the LEDs 22.

The LEDs 22 are provided at a position overlapping at least a part outward of the radiator 13 when seen planarly, preferably at a position that is at a more inner side than the outer circumference of the radiator 13 and corresponds to the upper side of the heat-radiating fins 32 when seen planarly. In other words, the LEDs 22 are provided at a position that is outward more than the storage part 81 when seen planarly, that is, at a position outside the fan parts 108 of the fan 94 of the air-cooling unit 15.

Then, having the configuration similar to that of each of the above-mentioned embodiments such that the one edge side of the radiator 13 is brought into close contact with the other main surface 21*b* of the substrate main body 21 having the LEDs 22 on the one main surface 21*a* and the air-cooling unit 15 is stored in the storage part 81 inside the radiator 13 while the drive circuit 85 for driving the air-cooling-unit 15 is provided to the substrate main body 21 enables to obtain an effect similar to that of each of the above-mentioned embodiments.

Figure 17:
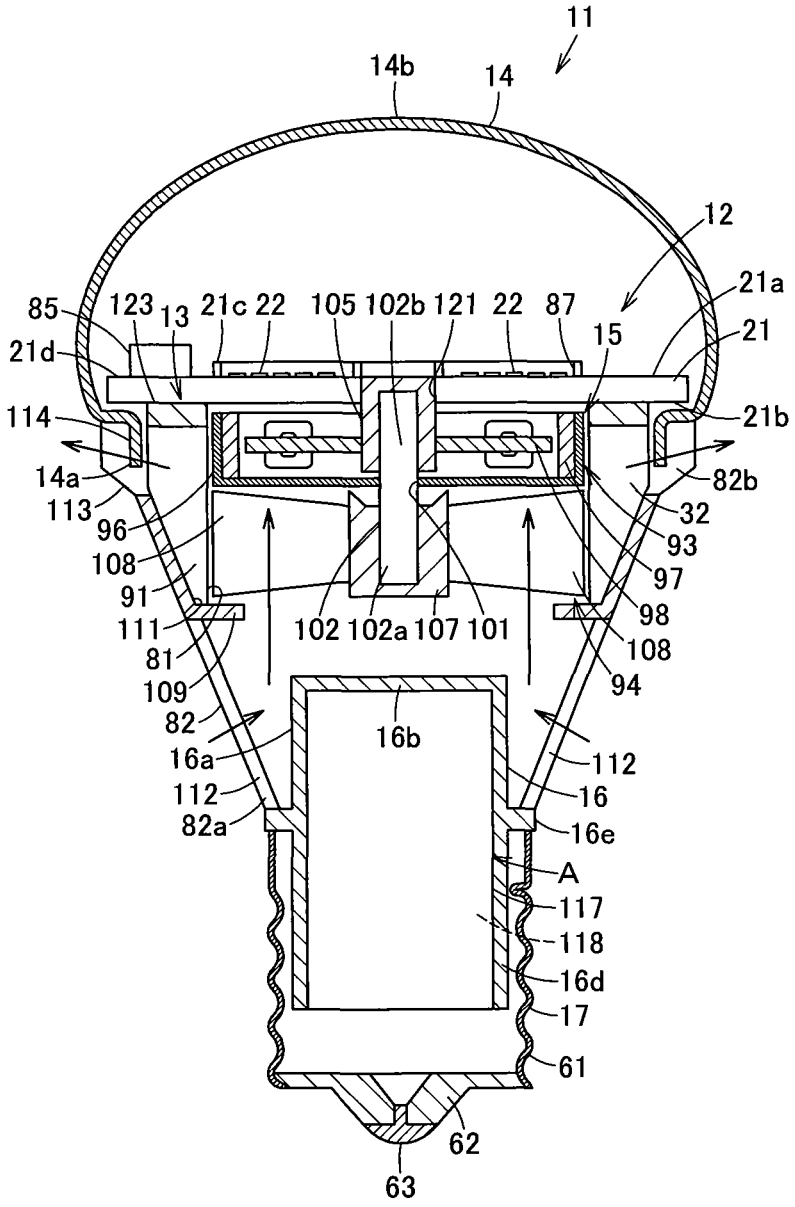
FIG. 17 is a longitudinal-sectional view of a self-ballasted lamp showing an embodiment of the present invention.

Next, an embodiment is shown in FIG. 17. FIG. 17 is a longitudinal-sectional view of a self-ballasted lamp. Here, the same reference numerals are given to the components having the same configuration and actions as those in each of the above-mentioned embodiments and description thereof is omitted.

In the embodiment, the radiator 13 in the above-mentioned embodiment is formed in a circular shape in which the plurality of heat-radiating fins 32 are connected to an upper edge side (one edge side), that is, to the substrate main body 21 side and the storage part 81 is formed to penetrate the radiator 13 from the upper edge side to a lower edge side (the other edge side).

Therefore, the upper edge side of the heat-radiating fins 32 becomes a position corresponding to the outer circumference edge part 21*d*, that is, a circular substrate attachment surface 123 which is in close contact with the other main surface 21*b* of the substrate main body 21 outside of the casing 21*c* (provision area 87).

Therefore, a distance between the motor 93 and the substrate main body 21 is narrower, the radiator 13 is not provided between the motor 93 and the substrate main body 21, and the motor 93 is provided at a position facing the other main surface 21*b* of the substrate main body 21 and corresponding to the casing part 21*c* (provision area 87).

Then, the storage part 81 is formed penetrating the radiator 13 and the axis receiving part 105 is press fitted into the substrate main body 21 to cause the motor 93 and the fan 94 of the air-cooling unit 15 to be closer to the other main surface 21*b* of the substrate main body 21. Therefore, it becomes possible to ensure more space inside the main body case 82 of the self-ballasted lamp 11. Therefore, it becomes possible to reliably reduce the size and to blow air blast by the rotation-drive of the fan 94 directly to the other surface 21*b* of the substrate main body 21 so that the heat radiation effect can be ensured.

Figure 18:
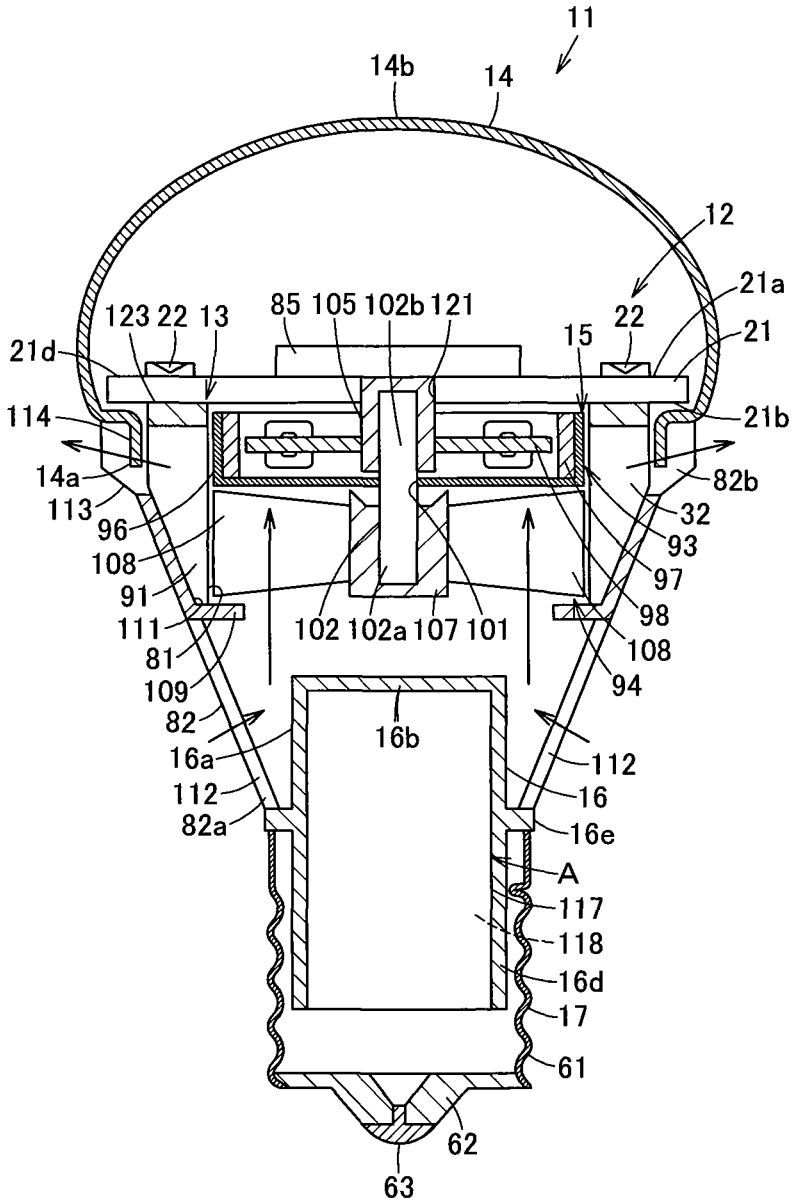
FIG. 18 is a longitudinal-sectional view of a self-ballasted lamp showing a further embodiment of the present invention.

Next, an embodiment is shown in FIG. 18. FIG. 18 is a longitudinal-sectional view of a self-ballasted lamp. Here, the same reference numerals are given to the components having the same configuration and actions as those in each of the above-mentioned embodiments and description thereof is omitted.

In this embodiment, the plurality of heat-radiating fins 32 are connected to an upper edge side (one edge side), that is, to the substrate main body 21 side to form a circular shape similar to the above-mentioned embodiment in the further above-described embodiment, and the storage part 81 is formed penetrating the radiator 13 from the upper edge side to the lower edge side (the other edge side).

Then, such a configuration enables to obtain the same effect as that of the above-mentioned embodiments.

Here, in the above-mentioned embodiments, the LEDs 22 may be provided at unequal intervals, width of the LEDs 22 in the circumferential direction may be large in part, and the LEDs 22 may be provided in the substantially center portion of the provision area 87 as long as the LEDs 22 are provided on the one same circumference. Provision of the LEDs 22 can be accordingly adjusted in the thermal design of the self-ballasted LED lamp 11.

Moreover, the drive circuit 85 may be provided at an arbitrary position that does not prevent light emitted from the light emitting element.

Further, instead of the axial flow fan, a centrifugal fan may be used as the fan 94.

Further, the air-cooling unit 15 does not need to unitize the motor 93 and the fan 94 and may include them separately. In this case, size of the fan 94 may be larger so that more cooling air can be obtained.

Further, in the air-cooling unit 15, the fan 94 may be provided between the substrate main body 21 and the motor 93.

What is claimed is:

1. A lighting device comprising:

a substrate having a first surface on which a light emitting element is provided and a second surface opposite the first surface;

a radiator having one edge side to which the second surface of the substrate is attached;

a cover which covers the substrate and is attached to the one edge side of the radiator;

a lighting circuit provided on another edge side of the radiator and configured to light the light emitting element; and an air-cooling unit provided between the radiator and the lighting circuit and configured to allow for ventilation of an interior of the radiator, wherein the radiator includes a plurality of ventilation openings including:

a suction opening configured to bring air into the interior of the radiator; and an air outlet configured to discharge the air, brought into the interior of the radiator through the suction hole, toward the cover to cause the discharged air to contact a surface of the cover.

2. The lighting device according to claim 1, wherein the radiator is formed of a resin material.

3. The lighting device according to claim 1, wherein:

the radiator includes a storage part where the air-cooling unit is stored inside, and the lighting device further includes a drive circuit provided to the substrate and configured to drive the air-cooling unit.

4. The lighting device according to claim 3, wherein:

the air-cooling unit includes a fan provided so as to face the second surface of the substrate, the lighting device further includes a motor provided between the fan and the substrate to be attached at least one of the substrate and the radiator, and the motor is configured to be driven by the drive circuit to rotationally drive the fan.

5. The lighting device according to claim 3, wherein the drive circuit is provided on the first surface of the substrate.

* * * * *